United States Patent [19]

Kennedy et al.

[11] 4,390,438

[45] Jun. 28, 1983

[54] DIBASIC ACIDS TO REDUCE COEFFICIENT OF FRICTION IN ROLLING OILS

[75] Inventors: Carl S. Kennedy, Dyer, Ind.; Fred Zellmann, Evergreen Park, Ill.

[73] Assignee: Nalco Chemical Company, Oak Brook, Ill.

[21] Appl. No.: 312,066

[22] Filed: Oct. 16, 1981

[51] Int. Cl.[3] ..... C10M 1/24

[52] U.S. Cl. ..... 252/56 D; 72/42; 252/49.5

[58] Field of Search ..... 252/56 S, 56 R, 56 D, 252/49.5

[56] References Cited

U.S. PATENT DOCUMENTS

| | | | |
|---|---|---|---|
| 2,565,938 | 8/1951 | Williams | 252/49.5 |
| 2,788,326 | 4/1957 | Bondi et al. | 252/56 D |
| 3,192,163 | 6/1965 | Hodge | 252/49.5 |
| 3,223,635 | 12/1965 | Dwyer et al. | 252/49.5 |
| 3,483,124 | 12/1969 | Johnson | 252/49.5 |
| 3,657,126 | 4/1972 | Sawyer | 252/49.5 |
| 3,769,215 | 10/1973 | Sturwold et al. | 252/56 S |
| 4,138,348 | 2/1979 | Grasshoff | 252/49.5 X |

OTHER PUBLICATIONS

Bastian, "Metalworking Lubricant", 1951, p. 14.

*Primary Examiner*—Andrew Metz

*Attorney, Agent, or Firm*—John G. Premo; Robert A. Miller

[57] ABSTRACT

An improved high-content animal fat rolling oil formulation used for cold rolling sheet steel and steel strip for tin plate is achieved by adding effective amounts of a saturated dibasic acid containing from 4–4 carbon atoms to an animal fat formulation including:

1. refined animal fat,
2. minor portions of lubricity additives,
3. anti-oxidants, and
4. emulsifiers and other additives.

This improved rolling oil formulation exhibits a drastically decreased coefficient of friction when applied between two metal surfaces.

3 Claims, No Drawings

DIBASIC ACIDS TO REDUCE COEFFICIENT OF FRICTION IN ROLLING OILS

INTRODUCTION

The technology of rolling oils, specifically those used for cold rolling of sheet steel strip or steel strip for tin plate, is still considered by many to be a black art. However, much advancement has been made in determining what is necessary for a particular rolling oil to show performance which is desired by steel mill operators. The basic approach to determining performance features of a rolling oil in service are reflected by a series of laboratory tests which may be used to assess the main attributes required of such a rolling oil formulation. These attributes are:

1. The oil must have a built-in emulsifiability which will allow sufficient oil plate out on the metal surfaces being rolled and reduced in size but which will not allow the oil system to become unstable in the emulsion holding tanks so that the rolling oil emulsion will separate into its organic and aqueous phases.

2. The rolling oil must not promote and, better, it must prevent corrosion of the metal strip between cold rolling reduction and further processing of this strip.

3. It must not stain the metal strip being processed either before or during post-rolling processes.

4. The chemical attack due to the rolling oil formulation must be minimal on all mill equipment and metal strip being processed.

5. Most importantly, the oil must provide the lowest possible positive coefficient of friction between the strip being processed and reduced in size and the rolls being used to accomplish this task.

The most important performance feature is the attainment of a lubricity which is characterized by providing to the mill operator a rolling oil formulation having the lowest possible positive coefficient of friction between the metal strip being processed and reduced in size and the rolls being used to accomplish this size reduction. If an oil fails to provide appropriate lubricity, it cannot perform its primary function in the reducing mill.

The prior art has taught that rolling oils may be synthesized using various types of organic oils. A popular medium comprising a major portion of these rolling oils is a refined animal fat, such as tallow or choice white grease. Both from the point of view of effectiveness and from the point of view of cost, these refined animal fat substances provide the formulator with a major portion of the rolling oil formulation. However, these materials alone do not have sufficient lubricity to yield the required low coefficient of friction. Therefore, the prior art has taught that lubricity additives may be blended with and dissolved in the animal fat used in the rolling oil formulation to provide increased lubricity. Such lubricity additives include fatty esters of dimer and trimer acids which are, in turn, high molecular weight difunctional carboxylic acid materials. Other lubricity additives include the polyol esters of fatty acids containing from 12–22 carbon atoms, or mixtures thereof, the preferred polyols having from 2–12 hydroxy groups and at least 5 carbon atoms. These lubricity additives are taught in U.S. Pat. Nos. 3,620,290; 3,526,596; 3,483,124; 3,223,635; and 3,124,531, all of which are incorporated by reference in this application.

In addition, various other additives are known in the art to accomplish some of the goals mentioned above. For example, emulsifiers of numerous types are added so as to accomplish the oil plate out phenomenon previously mentioned while maintaining the stability of the emulsion when stored in holding tanks prior to its use. Corrosion inhibitors may be added to prevent corrosion of the strip being processed, low molecular weight organic acids may be added for pH control, and small portions of oil-soluble anti-oxidants may be added to improve the stability of the rolling oil formulation and occasionally to assist in the corrosion protection of the processed metallic strip.

THE INVENTION

The current invention is an improved high content animal fat rolling oil formulation used in cold rolling steel in a steel sheet mill and in cold rolling steel strip for a tin plate to accomplish a reduction in thickness of the processed metallic sheet, the improved high content animal fat rolling oil formulation containing a major portion of a refined animal fat, minor portions of dimer acid ester lubricity additives, oleic acid, anti-oxidants, emulsifiers, and mixtures thereof, and at least 0.2 weight percent of a saturated dibasic acid containing from 4–14 carbon atoms.

The improved high content animal fat rolling oil formulation preferably contains a major portion of a refined animal fat such as tallow or choice white grease. The amount of tallow and/or choice white grease is at least 50 weight percent, and is most preferably at least 85 weight percent of the rolling oil formulation.

The lubricity additives are normally chosen from dimer acid esters, sulfurized fats, blown soybean oil, or fish oils. The lubricity additives are normally present at from 2–8 weight percent and are preferably present between 4–6 weight percent. Other lubricity additives may also be used in this invention and the choice of lubricity additives is not critical to the success of this improved rolling oil invention.

When process waters require it, low molecular weight organic acids, soluble in the rolling oil formulation, may be added to the rolling oil formulation for purposes of pH control. If process waters do not require this type of pH control, these organic acids may be deleted from the formulation without having an effect on its effectiveness. Anti-oxidants are also added, generally in a range between 0.1 and 1.0 weight percent to protect the rolling oil formulation against premature oxidation and destabilization.

Certain formulations are improved by adding to them a refined Red oil, or oleic acid component. The commercial materials tested below contained from 2–8 weight percent oleic acid, and preferably contained from 4–6 weight percent of this fatty acid additive.

Emulsifier systems are also devised and designed to enhance oil plate out on the metal surface being reduced in size while guaranteeing that emulsion stability is maintained in the storage vessels. Emulsifier systems may be combined emulsifiers, normally having HLB's between 2 and 30 and the total emulsifier system is normally present at about 0.5 to 2.5 weight percent, and preferably are added to between 1.0–2.0 weight percent.

The critical aspect of this invention is the addition of at least 0.2 weight percent of a saturated dibasic acid having from 4–4 carbon atoms to the rolling oil formulation containing the major portion of tallow or choice white grease, and minor portions of lubricity additives, oleic acid, low molecular weight organic acids, anti-oxidants, and emulsifiers. The preferred rolling oil formulation contains at least 0.2 weight percent of a saturated dibasic acid chosen from the group consisting of adipic acid, pimelic acid, suberic acid, azelaic acid, sebacic acid, and mixtures thereof.

The most preferred improved rolling oil contains at least 0.2 weight percent of azelaic acid.

The use of these improved rolling oil formulations provides an improved method of cold rolling steel strip by using an effective amount of this improved high content animal fat rolling oil formulation which contains at least 0.2 weight percent of a saturated dibasic acid containing from 4–14 carbon atoms. The preferred saturated dibasic acid is chosen from the group consisting of adipic acid, pimelic acid, suberic acid, azelaic acid, sebacic acid, and mixtures thereof. A most preferred saturated dibasic acid is azelaic acid.

EXAMPLES

To demonstrate the improvement obtained by the addition of small quantities of saturated dibasic acids to a high content animal fat rolling oil formulation, we present the data contained in Table I.

Compound A is a commercial rolling oil which contains a major portion of tallow, about 4 weight percent of a dimer acid ester lubricity additive, and minor amounts of oleic acid, antioxidants, emulsifiers, and other additives. The test results are obtained by using ASTM Standard Method D2714-68 which outlines the calibration and operation of the Alpha Model LFW-1 friction and wear testing apparatus.

In this procedure, a stationary rectangular test block is pressed with a predetermined load against a metallic rotating ring. The load is accurately maintained throughout the test. The resulting coefficient of friction is indicated throughout the test by a dial indicator; and a counter records the number of revolutions of a test specimen.

Coefficient of friction between two surfaces is the ratio of the force required to move one over the other to the total force pressing the two together. Table I indicates the compound tested and the revolutions under which the test results, reported as the coefficient of friction, were obtained. In addition, a measurement of the width of scar obtained by frictional contact of these two metal parts is noted in Table I. Generally speaking, the width of the scar is a measure of the effectiveness of the rolling oil in lowering the coefficient of friction between the two metal pieces. Generally, the smaller the scar width, the more effective is the rolling oil.

The data presented in Table I is, other than the scar width, the actual measured coefficient of friction obtained at 200, 400, 600, and 4500 revolutions when each of the test rolling oils are tested.

TABLE I

| Alpha | Rolling Oil | | | | | | | | | |
|---|---|---|---|---|---|---|---|---|---|---|
| Revolution | A | B | C | $D_1$ | $D_2$ | E | F | G | H | J |
| 200 | .129 | .101 | .123 | .056 | .053 | NORMAL | .12 | .056 | .053 | .080 |
| 400 | .121 | .096 | .120 | .057 | .048 | " | .12 | .056 | .051 | .064 |
| 600 | .116 | .088 | .115 | .056 | .047 | " | .11 | .056 | .049 | .051 |
| 4500 | .079 | .065 | .096 | .040 | .043 | " | .09 | .043 | .044 | .051 |
| Scar width, mm. | 3.5 | 2.4 | 4.1 | 2.0 | 2.0 | — | — | 2.0 | — | —120 |

As can be seen from the results in Table I, rolling oil B, which is a formulated rolling oil from Compound A which contains 0.2 weight percent of azelaic acid shows approximately a 20% drop in the coefficient of friction with a concurrent decrease in the width of the scar. This indicates that the addition of this amount of azelaic acid has improved performance of the rolling oil Formulation A to which it was added.

Rolling oil C is another high content animal fat rolling oil formulation containing lubricity additives, antioxidants, emulsifiers, and other additives in small proportion, and is a commercial rolling oil. Coefficient of friction measured is high and, in some cases, commercially acceptable; but it is dramatically improved by the addition of small quantities of the saturated dibasic acids of this invention. Rolling oil $D_1$ is the same formulation as C, but contains 0.5 weight percent of a commercially available crude fatty acid formulation containing about 40 weight percent azelaic acid. The Formulation $D_1$ shows a dramatically decreased coefficient of friction being obtained using the Alpha tester. Formulation $D_2$ contains 0.75 weight percent of the crude commercial formulation containing approximately 40 percent azelaic acid.

Formulation E is, again, yet another commercial high content animal fat rolling oil which gives normal, i.e., similar to those of oils A and C, coefficient of frictions in the Alpha tester. The addition of 0.08% azelaic acid to Formulation E, as Formulation F, gives results which only slightly decrease the coefficient of friction from values obtained in the original formulation. The addition of 0.25 weight percent of azelaic acid to Formulation E, as Formulation G, dramatically decreases the coefficient of friction and the scar width measurement and indicates a drastically improved rolling oil formulation. Rolling oil Formulation H, again, indicates a decrease in the coefficient of friction and contains approximately 0.5 weight percent azelaic acid added to the E formulations. Formulation J indicates a decreased coefficient of friction but this time contains 0.3 weight percent adipic acid added to the E Formulation demonstrating the general effectiveness of these low to intermediate molecular weight dibasic acids.

As can be seen from the data presented in Table I, and as explained in the previous paragraphs, our invention is an improved high content animal fat rolling oil containing a major portion of a refined animal fat, minor portions of lubricity additives, oleic acid, anti-oxidants, emulsifiers, and other additives, to which has been added at least 0.2 weight percent of a saturated dibasic acid containing from 4–14 carbon atoms, preferably a saturated dibasic acid chosen from the group consisting of adipic acid, pimelic acid, suberic acid, azelaic acid, sebacic acid, and mixtures thereof.

The addition of small amounts of these dibasic acids drastically decreases the coefficient of friction between metallic surfaces when the rolling oil to which these dibasic acids have been added are applied thereon. The most preferred saturated dibasic acid additive used to decrease the coefficient of friction between two metallic surfaces is azelaic acid. The use of this improved rolling oil formulation provides an improved method of cold rolling sheet steel and steel for tin plate by adding to the surface of the metal being reduced in size an effective amount of this improved high content animal fat rolling oil formulation which has added to it at least 0.2 weight percent of the saturated dibasic acids mentioned above.

A material which contained 88% choice white grease was formulated by adding 5 weight percent of a high molecular weight dimer acid ester lubricity additive. To this mixture is added 5 weight percent of a fatty acid material containing oleic acid, stearic acid, and other fatty acid materials. This composition is tested on the Alpha tester to 1000 revolutions and a coefficient of friction equal to 0.091 is achieved.

To the above choice white grease formulation is added the crude dibasic fatty acid formulation containing approximately 40 weight percent azelaic acid. This improved formulation is tested in the Alpha tester to 1000 revolutions and a coefficient of friction equal to 0.013 is measured. This dramatic drop in the coefficient of friction, again, demonstrates the effectiveness of this invention.

Having described our invention, we claim:

1. In an improved high animal fat content rolling oil formulation used in cold rolling sheet steel and steel strip for tinplate, comprising a major portion of a refined animal fat, minor portions of lubricity additives, anti-oxidants and emulsifiers, the improvement comprising the further inclusion of a friction reducing amount of at least 0.2 weight percent of a saturated dibasic acid containing from 4–14 carbon atoms.

2. The improved high content animal fat rolling oil of claim 1 wherein the saturated dibasic acid is chosen from the group consisting of adipic acid, pimelic acid, suberic acid, azelaic acid, sebacic acid, and mixtures thereof.

3. The improved high content animal fat rolling oil of claim 1 wherein the saturated dibasic acid is azelaic acid.

* * * * *